United States Patent [19]

Lautenschläger et al.

[11] Patent Number: 4,517,706

[45] Date of Patent: May 21, 1985

[54] ADJUSTABLE CABINET HINGE HAVING A BIASED CATCH

[75] Inventors: Karl Lautenschläger; Horst Lautenschläger, both of Reinheim; Gerhard Lautenschläger, Brensbach, all of Fed. Rep. of Germany

[73] Assignee: Karl Lautenschlager KG, Mobelbeschlagfabrik, Reinheim, Fed. Rep. of Germany

[21] Appl. No.: 507,577

[22] Filed: Jun. 24, 1983

[30] Foreign Application Priority Data

Jun. 26, 1982 [DE] Fed. Rep. of Germany ..... 3223937
Jan. 17, 1983 [DE] Fed. Rep. of Germany ..... 3301279

[51] Int. Cl.[3] ..... E05D 7/04
[52] U.S. Cl. ..... 16/238; 16/257; 16/383
[58] Field of Search ..... 16/236, 237, 238, 245, 16/246, 251, 257, 259, 370, 382, 383

[56] References Cited

U.S. PATENT DOCUMENTS 4,131,968 1/1979 Grass ..... 16/238
4,423,537 1/1984 Salice ..... 16/382 X

*Primary Examiner*—Fred A. Silverberg

[57] ABSTRACT

Cabinet hinge having a supporting arm which can be snapped onto the mounting plate. The supporting arm (16) of the hinge is adjustably fastened to the mounting plate (14) that is previously mounted on the supporting wall (12) of a cabinet, and it has a slot (34) which is open at the end remote from the hinge articulation or is provided with an enlarged pass-through opening to admit the head (38) of a mounting screw (40) driven into the mounting plate (14). The mounting plate (14) is provided with a spring catch (wire spring 72) projecting beyond its lateral surface and associated with an abutment on the confronting inside surface of the supporting arm (16). The position of this abutment with respect to the tip (78) of the spring catch is selected such that the tip engages the abutment as soon as the shank of the mounting screw (40) reaches the area of transition from the slot (34) to the pass-through opening (36) or open end, as the case may be, of the slot.

17 Claims, 19 Drawing Figures

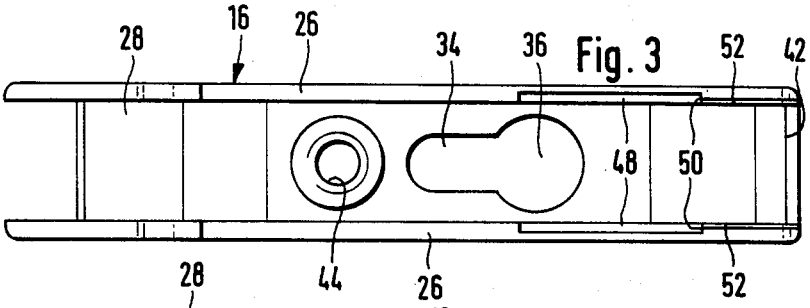
Fig. 3
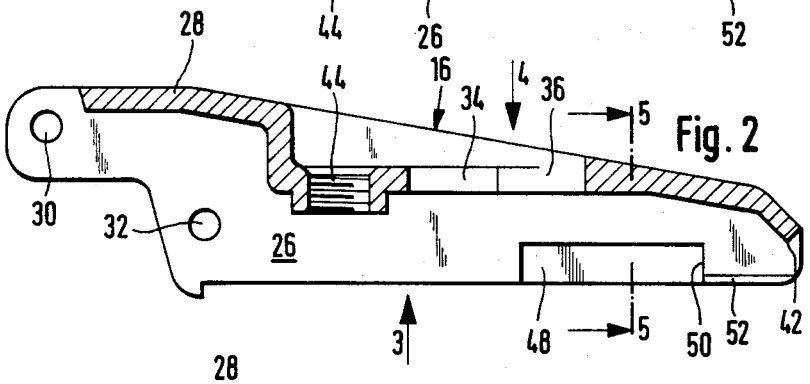
Fig. 2
Fig. 4
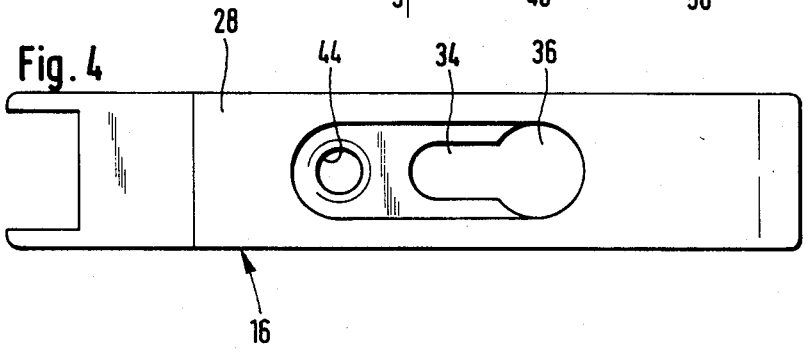
Fig. 5
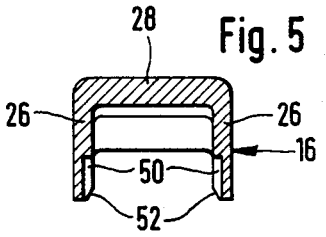

ADJUSTABLE CABINET HINGE HAVING A BIASED CATCH

The invention concerns a cabinet hinge having a supporting-wall-related part in the form of an elongated supporting arm coupled pivotally to the door-leaf-related part by a hinge articulation and having a substantially channel-shaped cross section, which arm is held releasably, and displaceably in at least two coordinate directions, on a mounting plate which can be fastened to the supporting wall of a cabinet carcass. The sides of the channel forming the supporting arm straddle the mounting plate at least partially and the web of the channel has an open-ended slot or one provided with an enlarged pass-through opening, and the shank of a mounting screw screwed into the mounting plate passes through the slot. The web is also provided, at a distance from the slot, with a tap containing a threaded spindle which bears against the mounting plate.

Cabinet hinges of such a configuration of the supporting arm and mounting plate (German Pat. No. 1,554,336 and German Offenlegungsschrift No. 2,614,446), which have been introduced in recent years for hanging doors on cabinet carcasses, have the advantage that the hinges, with the exception of the mounting plate affixed to the supporting wall of the carcass, are first mounted on the door, and then the door can be attached to the carcass simply by pushing the supporting arm onto the previously installed mounting plate, with the mounting screw loosened.

After the supporting arm has been placed or pushed onto the mounting plate, the mounting screw passed through the slot in the supporting arm must then immediately be tightened, while the door is being supported, at least to such an extent that the supporting arm will not be pulled back off the mounting plate by the weight of the door so that the door drops. On the other hand, however, the mounting screw has to be loosened for the purpose of the precise adjustment of the door leaf relative to the carcass, e.g., with regard to the amount of the door overlap, or for adjustment of the position of the closed door with respect to the carcass, and, in special cases, for the purpose of adjusting the level of the door relative to the carcass. That is to say, the mounting screw has to be backed out to a degree permitting the supporting arm to be pushed onto the mounting plate when the door is hung, and, before the subsequent adjustment of the door, it must be driven in again to a degree that will still permit the door to be adjusted, but prevent any unintentional separation of the supporting arm from its engagement with the mounting plate. In the hinge known from German Pat. No. 1,554,336, cooperating abutments are provided on the supporting arm and mounting plate for this purpose. These fixed abutments, however, make it necessary for the mounting screw to be backed out to a sufficient degree before hanging the door. Then, after the supporting arm has been mounted and the shank of its screw has been pushed from the pass-through opening into the slot by a certain amount, the mounting screw has to be driven in again only to an extent that will permit any necessary longitudinal adjustment to be made. Not until after the longitudinal adjustment has been made can the mounting screw be fully tightened to set the supporting arm in place. The assembly of a door on the corresponding cabinet carcass using hinges of the kind described above is in any case decidedly difficult, and, at least in cases in which no helper is available to hold the door while it is being installed, it requires special dexterity on the part of the installer. Furthermore, turning the mounting screw in by a certain amount after the supporting arm has been pushed onto the mounting plate requires a certain expenditure of time.

It is consequently the object of the invention to improve the known hinges such that, without losing the advantage of the ease of the installation of the supporting arm by placing it or pushing it onto the mounting plate, the hinges will be so secured after this has been done that unintentional separation of the supporting arm from the mounting plate will no longer be possible.

DESCRIPTION OF THE INVENTION

Setting out from a hinge of the kind mentioned in the beginning, this object is achieved in accordance with the invention by the fact that in at least one of the side walls of the supporting arm which straddle the mounting plate there is provided a recess or opening having an abutment running substantially at right angles to the surface of the supporting arm and facing the hinge-articulation end of the supporting arm. Then, in the portion of the mounting plate opposite the recess or opening there is disposed a catch element biased to a position in which it projects beyond the lateral surface of the mounting plate. This catch element has a tip at its free end, which is in such a position that the abutment on the supporting arm and the tip of the catch element will snap into engagement with one another when the supporting arm is displaced lengthwise on the mounting plate. This will occur as soon as the shank of the mounting screw driven into the mounting plate comes into the rearward area of transition between the slot and the pass-through opening or open end of the slot, as the case may be. As the supporting arm is pushed onto the corresponding mounting plate, therefore, the tip of the spring will snap into engagement with the abutment in the instant in which the mounting screw enters the slot in the supporting arm or groove in the mounting plate, as the case may be, and will prevent the supporting arm from pulling away from the mounting plate, and the door from falling, largely regardless of the depth to which the mounting screw has been backed out of its tap.

If the supporting arm is provided with a pass-through opening at the cabinet-interior end of the slot, it will be easier to push in the spring catch when the arm is slipped onto the mounting plate if the inside of the bottom edge of the side walls of the supporting arm is chamfered in the area that will be longitudinally aligned with the tip of the spring catch when the head of the mounting screw comes in line with the pass-through opening in the supporting arm.

The spring catch, in advantageous development of the invention, can consist of an end portion of a straight spring held in or on the mounting plate. For example, the straight spring can be in the form of a piece of metal spring wire disposed in a recess in the top of the mounting plate, with its one end fastened in the recess while its other, free end section extends through an opening in the wall of the mounting plate defining the side of the recess, and projects slightly beyond the associated lateral surface of the mounting plate. The free tip of the piece of metal wire therefore constitutes the catch element.

The arrangement of the piece of spring wire is best such that its free end section points away from the hinge linkage toward the interior of the cabinet.

At least at one of the lateral surfaces of the mounting plate which are straddled by the portion of the supporting arm side walls that is provided with the recess or opening, a low projection can be provided, having an abutment surface facing toward the interior of the cabinet and disposed at right angles to the supporting wall surface. This projection is slightly offset from the spring catch, toward the bottom of the mounting plate. This projection thus forms a fixed abutment on the mounting plate, which, by cooperating with the abutment on the supporting arm, also constitutes security against withdrawal of the supporting arm from the mounting plate, but at the same time—due to being closer to the bottom of the mounting plate than the spring catch—it will not become active until the mounting screw is turned more tightly into the mounting plate. That is to say that, even if the catch element, i.e., the wire spring in this particular case, is omitted, security is provided—the same as in the known hinges of the kind concerned herein—which will assure the adjustment of the hinge without the danger of unintentional separation of the supporting arm from the mounting plate.

The position of the abutment surface of the projection will then best be approximately the same as the location of the tip of the spring wire along the length of the mounting plate.

The configuration can also be such that a spring catch is provided on one of the lateral surfaces of the mounting plate and a projection with an abutment surface on the other lateral surface of the mounting plate.

Alternatively, a spring catch can also be provided on both lateral surfaces of the mounting plate along with a projection whose abutment surface is situated closer to the bottom of the mounting plate.

If the hinge of the invention is also to permit the door to be adjusted for height, i.e., an adjustment of the door relative to the carcass parallel to the hinge axis, the mounting plate is best divided, in a known manner, into a bottom part which can be fastened to the supporting wall, and a top part which can be displaced parallel to the supporting wall surface over a given range, and can be locked at any point within that range. A tap will then be provided for the screw for mounting the supporting arm.

In that case it is recommendable to lengthen the mounting plate beyond the associated end of the supporting arm at its cabinet-interior end remote from the hinge linkage, and in the lengthened end of the bottom part to provide a tap for a mounting screw whose shank will pass through a slot provided in the upper part and disposed in the direction of the displacement of the upper part. This mounting screw associated with the height adjustment of the hinge is thus accessible even when the supporting arm is installed and fixed in place, so that height adjustment can be performed without resulting in a change in the door overlap or in the inward adjustment of the door.

In the confronting surfaces of the prolonged end portion of the upper and lower parts of the mounting plate it is then expedient to provide a tongue-and-groove joint parallel with the direction of displacement of the upper part, which will permit the upper part of the mounting plate to be shifted relative to the bottom part only in the direction of the height of the door when the mounting screw is loosened.

In the front end portion on the hinge linkage end of the upper part of the mounting plate, however, a projection extends downwardly from its bottom and is provided with a hook extending from its free end parallel to the bottom surface of the bottom part, lengthwise of the mounting plate. Then, in the area of the bottom part of the mounting plate opposite this projection there is provided a through opening serving to accommodate the projection, this opening being wider than is the projection, and having a lip which can be engaged by the hook. The hook, therefore, will additionally secure the upper part of the mounting plate against lifting away from the bottom part at the end nearer the hinge linkage, without interfering with the height adjustment.

BRIEF DESCRIPTION OF THE DRAWING

The invention will be further explained in the description that follows of a number of embodiments, in conjunction with the drawing, wherein:

FIG. 2 is a longitudinal cross section through the supporting arm of the hinge shown in FIG. 1;

FIG. 3 is a bottom view of the supporting arm, as seen in the direction of the arrow 3 in FIG. 2;

FIG. 4 is a top view of the supporting arm, as seen in the direction of the arrow 4 in FIG. 2;

FIG. 5 is a cross section through the supporting arm, as seen in the direction of the arrows 5—5 in FIG. 2;

DESCRIPTION OF PREFERRED EMBODIMENTS

Figure 1:
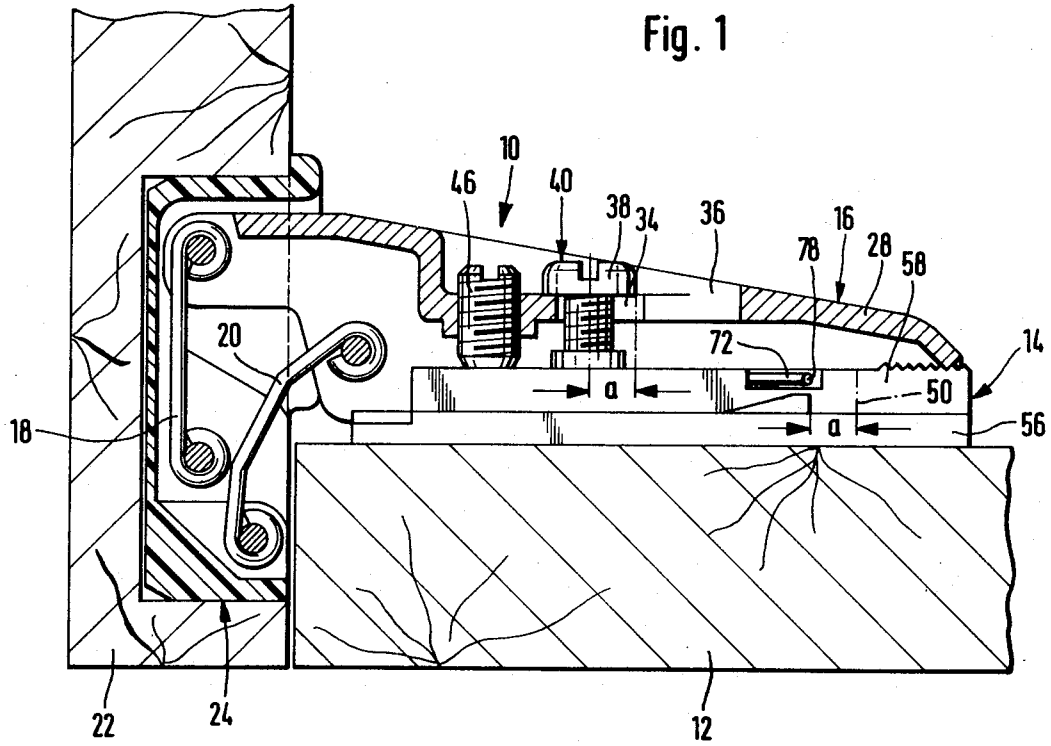
FIG. 1 is a longitudinal cross section through a hinge in accordance with the invention in the closed position.

The hinge of the invention shown in FIG. 1 and designated as a whole by 10 has a supporting-wall-related part made in the form of an elongated supporting arm 16 having a generally channel-shaped cross section and fastened adjustably on a mounting plate 14 premounted on the supporting wall 12 of a cabinet carcass. This supporting arm 16 is coupled to the door-related hinge part by two hinge links 18 and 20 pivotally mounted on the door end of the supporting arm 16 at one end and on or in the door-related hinge part at the other end, in the manner of a four-pivot articulation. The door-related hinge part is in the form of a cup 24 which is set in a bore or recess in the door leaf 22.

The elongated supporting arm 16 shown separately in FIGS. 2 to 5 has, as previously stated, a generally channel-shaped cross section, i.e., its parallel side walls 26 are joined together along their upper margins by a web 28. In the end portion situated on the left in FIGS. 2 to 4, two bores 30 and 32 are provided in the side walls 26 (FIG. 2) and serve for the accommodation of pivot pins to which the ends of the hinge links 18 and 20 are attached.

In the web 28 there is provided a slot 34 running lengthwise, whose end remote from the door leaf is expanded to form an opening 36 to admit the head 38 of a mounting screw 40 (FIG. 1) driven into the mounting plate 14 which will be described further below in conjunction with FIGS. 6 and 7. At its end remote from the door leaf the web 28 terminates in an edge 42 which is supported in the proper mounting position on the upper side of the mounting plate 14. Ahead of the slot 34 a tap 44 is provided centrally in the web 28, and into it there is threaded a headless screw 46 (FIG. 1) whose inner end between the side walls 26 bears against the upper side of the mounting plate 14. Longitudinal recesses 48 are molded or stamped in the inner surfaces of the side walls 26 in confronting areas, each of them forming at its end remote from the door leaf, i.e., at the right end in the drawings, a vertical abutment 50 at right angles to the inner surfaces of the side wall. The abutment 50 is adjoined by a chamfer along the bottom edges of the side walls 26, as indicated at 52.

Figure 6:
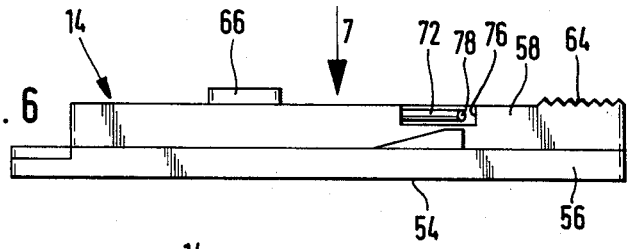
FIG. 6 is a side view of the mounting plate of the hinge shown in FIG. 1.
Figure 7:
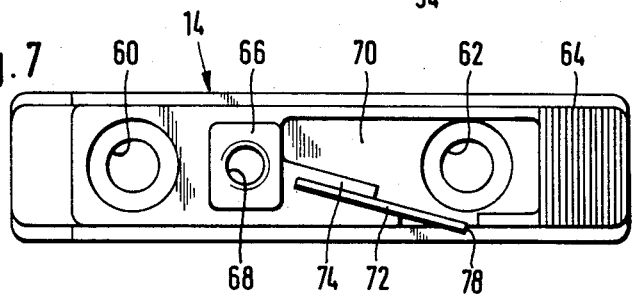
FIG. 7 is a top view of the mounting plate, as seen in the direction of the arrow 7 in FIG. 6.

In FIGS. 6 and 7, the mounting plate 14 is shown, which can be fastened to the supporting wall 12 of a cabinet carcass and is made in this case of die-cast metal, and on it the supporting arm 16 can be fastened. The mounting plate is in the form of two superimposed, elongated, platform-like sections, the lower one 56, whose surface 54 is to be placed on the supporting wall 12, having a slightly greater width than the upper section 58 superimposed centrally thereon whose width is approximately equal to the clearance between the inner faces of the side walls 26 of the supporting arm 16. The supporting arm 16 is therefore to be placed on the mounting plate 14 such that the side walls 26 straddle the upper platform section 58. Two chamfered through-bores 60 and 62 permit the mounting plate 14 to be fastened by associated flat-head screws to the desired point on the supporting wall 12 of a cabinet carcass. In the end portion remote from the door leaf, i.e., on the right side in the drawings, a fastening surface 64 with transverse serrations is provided on the upper side of the mounting plate, and on it is supported the edge 42 of the supporting arm when the latter is in the properly installed position.

The tap 68, which can be seen in FIG. 7, is provided in a raised portion 66 of the upper side of the mounting plate, to accommodate the mounting screw 40. Between the raised portion 66 and the serrated fastening surface 64, a recess 70 is formed, in which a spring consisting of a piece 72 of spring steel wire is held in the angled position shown in FIG. 7 between the wall surrounding the recess and a projection 74 rising from the bottom of the recess. The free end of the spring 72 extends through an opening 76 in the wall of the mounting plate that laterally defines the recess, and thus it projects beyond the lateral surface of the upper platform section 58 of the mounting plate. The rearward tip of the free end of spring 72, i.e., the end remote from the hinge articulation, forms a catch means 78 for cooperation with other catch means in the form of the abutment 50 of the recess 48 in the associated lateral wall 26 of the superimposed supporting arm. The position of the tip 78 of the spring 72 is selected such that, when screw 40 is loosened and the supporting arm 16 is shifted longitudinally on the mounting plate 14 away from the cabinet interior, i.e., leftward in FIG. 1, it will engage the abutment 50 of recess 48 just as the shank of the mounting screw 40 reaches the area of transition from the slot 34 to the pass-through opening 36. In FIG. 1 this is represented by the displacement distance a shown, in the one case, between the centerline of the mounting screw 40 and the transition between the elongated hole and the pass-through opening, and in the other case between the tip 78 of spring 72 and the abutment 50 (the latter indicated by broken lines). Any further displacement of the supporting arm is then blocked, i.e., the mounting screw 40 is prevented from moving into the pass-through opening 36. Consequently, the supporting arm 16 can be pulled upward away from the mounting plate only by backing the mounting screw out of the mounting plate to enable the supporting arm to be raised up from the mounting plate to such an extent that the portion of spring 72 protruding laterally from the platform 58 comes under the bottom edge of the side wall 26 of the supporting arm, thus disengaging the catch means 78 and 50 from one another. Then the supporting arm 16 can be displaced by the necessary additional amount and, when the head 38 of the mounting screw is aligned with the pass-through opening 36, it can be lifted away from the mounting plate 14.

On the other hand, if the supporting arm is to be fastened back onto the mounting plate, and the head 38 of mounting screw 40 is aligned with the pass-through opening 36, it will suffice to push the supporting arm firmly against the mounting plate. The chamfer 52 in the rearward internal end portion of supporting arm 16 will then force the projecting portion of spring 72 resiliently back into the opening 76, so that the screw head 38 can pass through the opening 36. By pushing the supporting arm then toward the interior of the cabinet, i.e., rightward in FIG. 1, the shank of the mounting screw 40 will then enter the slot 34 and the projecting part of spring 72 will enter into the recess 48 in the inner surfaces of the supporting arm side walls 26 and snap out of the opening 76 into the recess. The safety locking of the supporting arm on the mounting plate, which is assured by the cooperating catch means 78 and 50, is thus restored.

The catch in the form of the spring 72 is provided on only one side in the embodiment represented in the drawing and described above, i.e., the safety locking takes place between one side wall 26 of the supporting arm 16 and the confronting lateral surface of the upper platform 58 of the mounting plate 14. It is apparent, however, that it is easily possible to achieve a symmetrical duplication of the catch mechanism by having a piece of spring wire corresponding to the piece of spring wire 72 also project through an opening on the opposite side of platform 58 and cooperate with the recess 48 in the opposite side wall 26 of the supporting arm. The sections of spring wire 72 are then best constituted by the two legs of a hairpin spring set in the recess 70.

Figure 8:
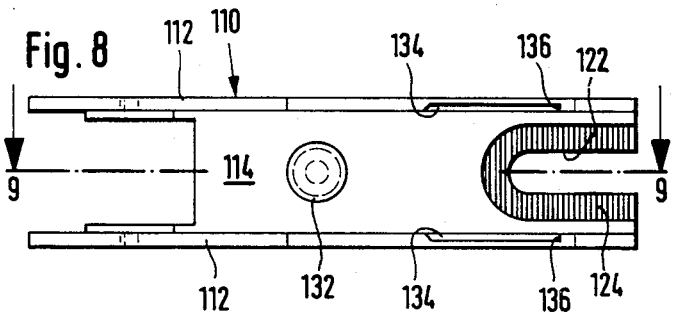
FIG. 8 is a bottom view of the supporting arm of a second embodiment of a hinge of the invention.
Figure 9:
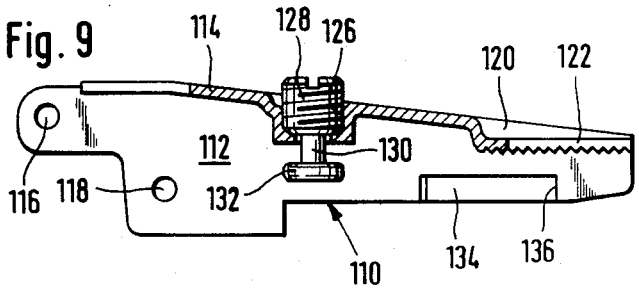
FIG. 9 is a cross section as seen in the direction of the arrows 9—9 in FIG. 8.

FIGS. 8 and 9 show the supporting-wall-related part of a second embodiment of a four-pivot hinge of the invention, in the form of a generally channel-like supporting arm 110 whose side walls 112 are joined along their upper edges by a web 114. In the end portion situated on the left side in the drawings, two bores 116 and 118 (FIG. 9) are provided in the sidewalls 112, and serve for the accommodation of pivot pins on which the pivot eyes of the links forming the hinge articulation are mounted. The pivot pins, the hinge links and the door-related part of the hinge can be the same as those of the four-pivot hinge shown in FIG. 1 and are therefore omitted from the drawings.

In the end portion 120 of the web 114, which is shown on the right in the figures, i.e., the end remote from the hinge linkage, and which is flattened and sunken between the side walls 112, there is provided an open-ended slot 122 which serves for the accommodation of the shank of a mounting screw (shown in FIG. 12) in the form of a headed screw by which the supporting arm is fastened at its end remote from the hinge links on a mounting plate which will be further described hereinbelow in conjunction with FIGS. 11 to 14 and 15 to 19. The sunken end portion 120 is provided on its bottom with transverse serrations 124.

At a distance from the sunken end portion 120 there is provided in the middle of the web 114 a tap 126 into which a headless screw 128 is driven. To the inside end of this headless screw, which is situated between the side walls, a generally circular-shaped holding disk 132 of larger diameter is attached by a short shaft 130 of smaller diameter. Between the threaded shank 126 and the holding disk 132, therefore, an annular groove is constituted, whose depth is defined by the diameter of the short shaft 130. In the inside surfaces of the side walls 112 there are molded or stamped oppositely situated, elongated recesses 134, which form at their ends remote from the hinge links, i.e., the right end in the figures, a vertical abutment 136 disposed at right angles to the inside surfaces of the side walls.

In FIGS. 11 to 14, there is represented a mounting plate 140, which can be fastened to the supporting wall of a cabinet carcass and in the present case is made in one piece of die-cast metal, and on which the supporting arm 110 can be fastened. The mounting plate is in the form of two superimposed, elongated platforms, the bottom one 144 of which, whose bottom 142 is to be placed against the supporting wall, has a slightly greater width than the centrally superimposed upper platform 146, whose width is approximately equal to the free clearance between the inside surfaces of the side walls 112 of the supporting arm 110. The supporting arm 110 can therefore be slipped onto the mounting plate 140 such that the side walls 112 straddle the upper platform-like section 146. Two countersunk through-bores 148 and 150 permit the mounting plate 140 to be fastened by means of associated flat-head screws at the correct position on the supporting wall of a cabinet carcass. In the end portion of the mounting plate 140 that is remote from the hinge articulation, i.e., on the right side of the drawing, there is provided a fastening surface 152 having transverse serrations matching the transverse serrations 124 in the end portion 120 of the supporting arm 110. A tap 154 is made approximately in the center of the fastening surface 152 and serves to accommodate the threaded shank 153 of a mounting screw 155, (FIG. 12) which is to be introduced through the slot 122 of the supporting arm 110. Between shank 153 and head 151 of mounting screw 155 a neck section 157 is provided which is smaller in diameter than the shank and without threads. Neck section 157 loosely fits in the longitudinal slot 122 of supporting arm 110 whereas the outer diameter of threaded shank 153 is somewhat larger than the width of the longitudinal slot. Consequently, upon loosening of mounting screw 155 the shoulder formed between threaded shank 153 and neck section 157 engages the underside of the areas laterally defining the longitudinal slot 122 in the end portion 120 of the supporting arm, and upon further loosening of the screw the shoulder pushes the end portion 120 away from the mounting plate 140. At its front end, the upper platform 146 is provided with a slot 156 which is open at the hinge linkage end, and which has along its upper longitudinal margins a mouth 160 narrowed by inwardly projecting portions 158. The mounting of the supporting arm 110 on the mounting plate 140 is performed by sliding the supporting arm with its slot under the head of the above-mentioned, previously loosened mounting screw in the tap 154, with the holding disk 132 engaged at the same time in the slot 156, so that the holding disk passes under the inwardly projecting portions 158 and prevents any lifting of the supporting arm 110 at right angles to the supporting wall surface.

It is clear that the supporting arm 110 can be fastened at selectable positions on the mounting plate within the length of the slot 122 and slot 156, the supporting arm being then secured against longitudinal movement by tightening the screw which tightens the transverse serrations 124 against the transverse serrations of the fastening surface 152. It is furthermore apparent that the distance between the front end of the supporting arm 110 and the bottom 142 of the mounting plate 140 can be varied by varying the depth to which the set screw 128 is driven into the tap 126. The supporting arm is therefore adjustable in two coordinates, namely longitudinally and at right angles to the length, namely perpendicularly to the supporting wall surface.

Figure 10:
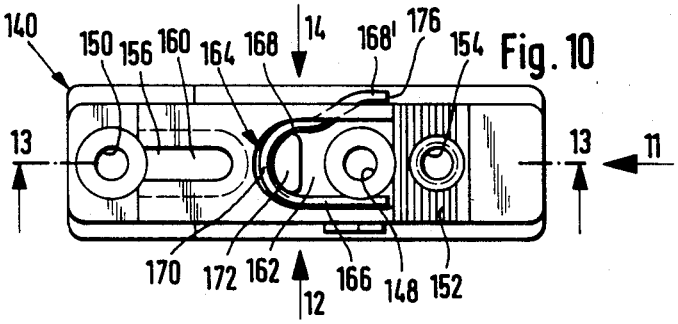
FIG. 10 is a top view of a mounting plate for the hinge provided with the supporting arm of FIG. 8.
Figure 13:
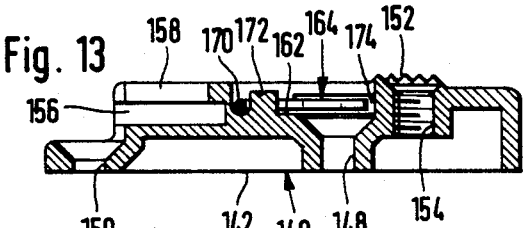
FIG. 13 is a cross sectional view as seen in the direction of the arrows 13—13 in FIG. 10.
Figure 14:
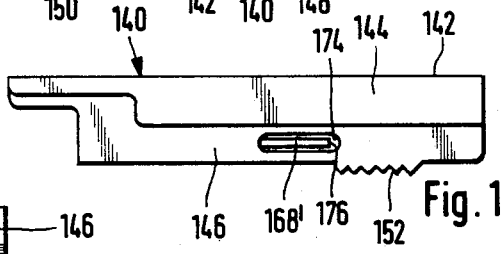
FIG. 14 is a side view of the mounting plate, as seen in the direction of the arrow 14 in FIG. 10.
Figure 11:
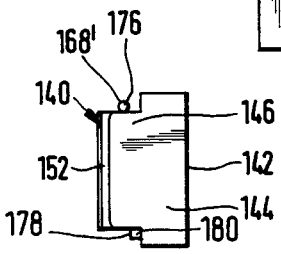
FIG. 11 is a front elevational view of the mounting plate, as seen in the direction of the arrow 11 in FIG. 10.

In the area between the mounting surface 152 and the slot 156, the mounting plate has on its upper side a recess 162 (FIGS. 10 and 13) in which a two-legged spring 164 made from spring steel wire is inserted and held at its bend 170 between its legs 166 and 168 by a projection 172 rising from the bottom of the recess. While the one leg 166 of the spring 164 is supported against the side wall of the recess 162, the dogleg portion 168' of leg 168 passes through a slot 174 in the corresponding side wall of the recess 162 and therefore projects beyond the lateral surface of the upper platform-like section 146 of the mounting plate 140. The rearwardly pointing tip 176 of leg 168, thus forms a catch which, when the supporting arm 110 is pushed onto the mounting plate, cooperates with the abutment 136 of the recess 134 such that, when the supporting arm is pushed on, the end section 168' of the leg 168 of the two-legged spring 164 is first pushed back by the side wall 112 until the abutment 136 of the recess 134 has moved past the catch 176 on the end section 168'. Then the end section 168' resiliently snaps into the recess 134 and the supporting arm 110 is secured against withdrawal from the mounting plate.

Figure 12:
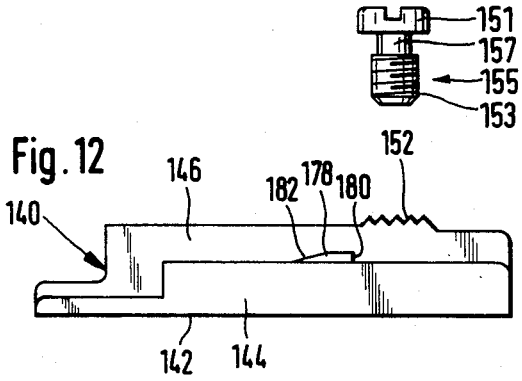
FIG. 12 is a side view of the mounting plate, as seen in the direction of the arrow 12 in FIG. 10.

On the opposite side of the mounting plate from the protruding spring leg 168', at the transition between the bottom and top platform-like sections 144 and 146, there is formed an elongated projection 178 (FIGS. 11 and 12) whose thickness is approximately equal to the depth of one of the recesses 134 in the sidewalls 112, and which has on its rearward (right-hand) end an abutment 180 at right angles to the supporting wall surface, which cooperates with the abutment 136 of the supporting arm, to the effect that any withdrawal of the supporting arm from the mounting plate is prevented as long as the supporting arm cannot be lifted by an amount corresponding to the height of the projection 178. Since, however, the projection 178, as can be seen in FIG. 12, is relatively low, a relatively slight loosening of the mounting screw will suffice to enable the supporting arm to be raised at its interior (right-hand) end to such an extent that the abutment 136 can be disengaged from the abutment 180. At its left end the projection 178 has a ramp 182, such that the inner end of the supporting arm 110 will slide up on this ramp when it is pushed onto the mounting plate 140.

Since the projection 178 is set lower, i.e., nearer to the bottom 142 of the mounting plate, than the end section 168' of the leg 168, the arrangement is such that the resilient locking by means of the spring 164 is still effective even with the mounting screw more greatly loosened, if the abutment 136 of the supporting arm can already pass beyond the abutment 180 of the projection 178. But on the other hand it is also such that, with the spring 164 removed from the recess 162, it is possible to secure the supporting arm 110 against withdrawal from the mounting plate if the mounting screw is turned in more tightly by a corresponding amount.

Before installing the supporting arm, the mounting screw 155 which holds the supporting arm 110 on the mounting plate 140 should be driven into the tap 154 so far that the supporting arm 110 can still be pushed past the projection 178, while forcing the end portion 168' of the leg 168 to bend back into the mounting plate until this end portion snaps into the recess 134. Withdrawal of the supporting arm is then no longer possible without additional backing off of the mounting screw, because the tip 176 of the protruding end section 168' cannot clear the abutment 136 of the recess 134. It is desirable for the mounting plate 140 to be delivered from the factory with the mounting screw already turned to such a depth.

Figure 17:
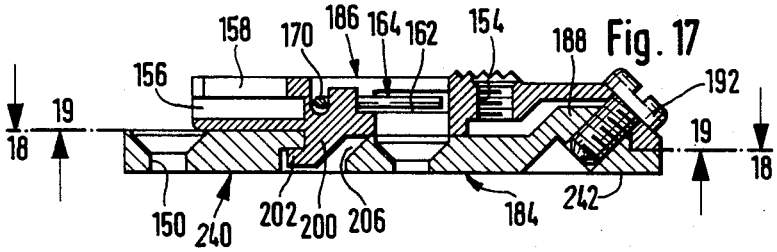
FIG. 17 is a cross sectional view in the direction of the arrows 17—17 in FIG. 15
Figure 15:
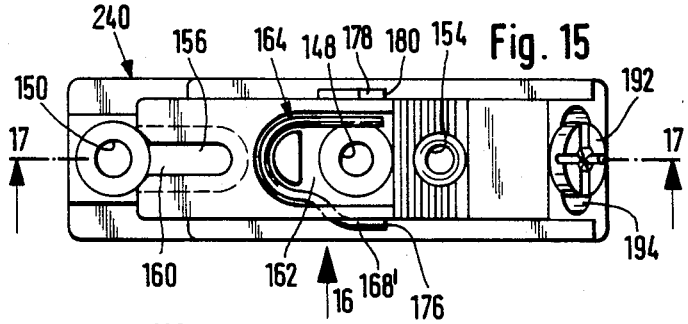
FIG. 15 is a plane view of a modified mounting plate for the hinge provided with the supporting arm of FIG. 8.
Figure 16:
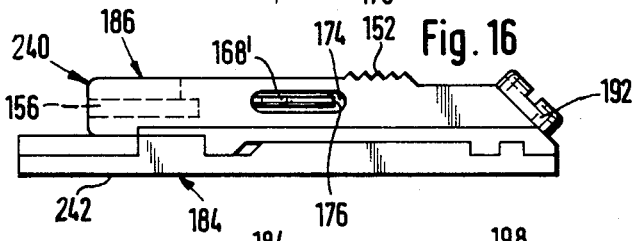
FIG. 16 is a side view of the mounting plate, as seen in the direction of the arrow 16 in FIG. 15.
Figure 18:
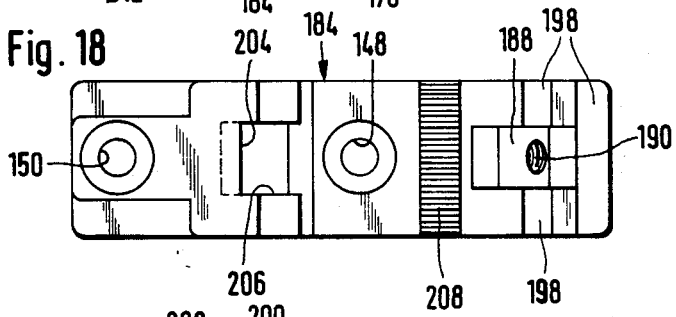
FIG. 18 is a top view of the lower part of the mounting plate shown in FIGS. 15 to 17, as seen in the direction of the arrows 18—18 in FIG. 17.
Figure 19:
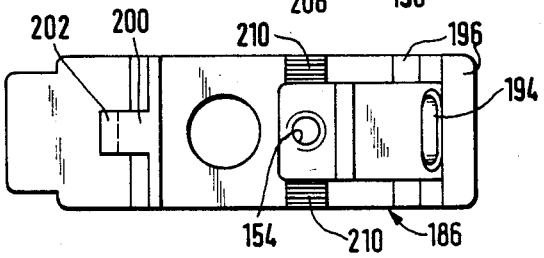
FIG. 19 is a bottom view of the upper part of the mounting plate shown in FIGS. 15 to 17, as seen in the direction of the arrows 19—19 in FIG. 17.

The mounting plate 240 shown in FIGS. 15 to 17 corresponds largely to the mounting plate 140 described above, and in the drawing, functionally equal parts of the two mounting plates are provided with the same reference numbers as the corresponding parts of mounting plate 140, but with the hundreds digit increased by "1". To avoid repetition, therefore, only those features of the mounting plate 240 which are different from those of mounting plate 140 will be described below, while it will suffice otherwise to consult the description given above.

The important difference between mounting plate 240 an mounting plate 140 is that mounting plate 240 consists of two parts, namely a bottom part 184 (FIG. 18) and a top part 186 (FIG. 19), which are displaceable relative to one another by a given amount at right angles to the long axis of the mounting plate, parallel to the supporting wall surface of a cabinet carcass, and can be locked within that range at any desired position. For this purpose the mounting plate 240, that is, both the upper and the lower parts 186 and 184, is prolonged at the end opposite the hinge articulation beyond the end of the associated supporting arm 210 that will be fastened on the mounting plate. In the prolonged end portion of the bottom part 184, a tap 190 is provided in a rearwardly sloping surface of a projection 188 engaged in a recess in the upper part. Into this tap is driven a screw 192 which passes first through a slot running in the direction of adjustment. This slot is in a rear transverse wall of upper part 186 which slopes to correspond to the sloping surface of the projection 188. When the screw 192 is loosened, therefore, the upper part 186 is displaceable on the bottom part 184, while tongues 196 projecting from the bottom of the upper part 186 engage associated complementary grooves 198, and thus prevent rotation of the loosened upper part relative to the bottom part, i.e., they permit only a transverse displacement of the mounting plate parts with respect to one another.

Additionally, the upper part 186 is secured against lifting from the bottom part by means of a projection 200 on the bottom side in its front end portion on the hinge articulation end. This projection has a hook 202 extending from its free end parallel to the bottom 242 of the bottom part 184 toward the front or hinge-articulation end. The hook 202 is adapted to engage an edge 204 defining a through-aperture 206 in the bottom part 184, into which the projection 200 enters. This aperture 206 is wider by the necessary amount of displacement, than the projection 200. To secure a relative adjustment of the upper part 186 on the bottom part 184, strips 208 and 210 having complementary serrations running lengthwise are provided in the confronting surfaces of bottom part 184 and top part 186, and these serrations are tightened against one another in interlocking engagement when the screw 192 is tightened.

It can be seen that variations and further developments of the above-described embodiments can be made within the scope of the invention. In particular, the locking, in accordance with the invention, between the supporting arm and the mounting plate is not limited to the above-described four-pivot hinge, but can also be applied to hinges whose articulation mechanism is constructed according to another kinematic principle, as in the case, for example, of single-articulation or crosslink hinges.

We claim:

1. A cabinet hinge having a supporting-wall-related part in the form of an elongated supporting arm of substantially channel-shaped cross section; a door-related part; hinge link means pivotally coupling said two parts so as to be pivotable about a pivot axis; a mounting plate adapted to be fastened to a supporting wall surface of a cabinet and having a bottom surface for placement on said supporting wall, a top surface essentially parallel to the supporting wall when mounted thereto, and also having at least one side surface essentially perpendicular to said top surface; said supporting arm being held releasably and adjustably in at least two coordinate directions on said mounting plate, said supporting arm having supporting-arm side walls at least partially straddling said mounting plate and also having a web joining said supporting-arm side walls, said web having a slot which is provided at a transition area remote from said hinge link with an access opening; a mounting screw having a head, and a shank which is driven into said mounting plate and is adapted to pass from said access opening into said slot; said supporting arm also being provided at a distance from said slot in said web with a tap through which may pass a headless screw for bearing against said mounting plate; a recess in at least one of said supporting-arm side walls and having an abutment running substantially at right angles to said top surface of said mounting plate and facing toward the hinge link end of said supporting arm; a resilient catch element disposed in the area of said mounting plate opposite said recess, said catch element being biased to a position in which it protrudes beyond said at least one side surface of said mounting plate, said catch element having a movable tip pointing in a direction away from said hinge link, said abutment and said tip being in such a position that upon a longitudinal displacement of said supporting arm on said mounting plate parallel to said top surface, said abutment and tip will snap into engagement with one another when said shank of said mounting screw driven into said mounting plate arrives in said transition area from said slot to said access opening.

2. A hinge according to claim 1, wherein said access opening is a circular opening having a diameter larger than the width of said slot.

3. A hinge according to claim 1, wherein said access opening is an open end of said slot.

4. A hinge according to claim 1, wherein a chamfer is provided on the inside of the side wall of the supporting arm in an area longitudinally aligned with said tip of said catch element when the head of said mounting screw driven into the said mounting plate is aligned with said access opening.

5. A hinge according to claim 1, wherein said catch element is formed by an end section of a spring mounted at said mounting plate.

6. A hinge according to claim 5, wherein said spring is in the form of a section of a metal spring wire disposed in another recess in said top surface of said mounting plate, said wire having one end section fastened in said another recess and another free end section projecting through an opening in and slightly beyond said side surface of said mounting plate.

7. A hinge according to claim 6, wherein said free end section points away from said hinge link.

8. A hinge according to claim 6, wherein said spring is in the form of a two-legged hairpin spring disposed in said mounting-plate recess and having two free leg end sections, at least one of which passes through said side surface opening, said side surface opening being a slot-like opening in a wall of the mounting plate laterally defining said mounting-plate recess.

9. A hinge according to claim 8, wherein said free leg end sections point away from said hinge link.

10. A hinge according to claim 1, wherein a projection is provided on at least one side surface of said mounting plate which is straddled by an area of the least one supporting-arm side wall provided with said recess, said projection having an abutment surface pointing away from said hinge link at right angles to said top surface, and being slightly offset with respect to said catch element in a direction towards said bottom surface.

11. A hinge according to claim 10, wherein the position of the abutment surface of the projection lengthwise of said mounting plate corresponds approximately to the position of said tip of said catch element.

12. A hinge according to claim 1, wherein said catch element is provided on one of said side surfaces of said mounting plate, and a projection having an abutment surface is provided on the other side surface of said mounting plate.

13. A hinge according to claim 1, wherein said mounting plate is divided into a bottom part adapted to be fastened to the supporting wall and having said bottom surface, and a top part adapted to be shifted on said bottom part parallel to said pivot axis of said hinge and parallel to said bottom surface by a given amount, and adapted to be fixed at selectable positions with respect to said bottom part, said tap for said mounting screw of the supporting arm being provided in said top part.

14. A hinge according to claim 13, wherein at its end remote from said hinge link said mounting plate is prolonged beyond said supporting arm and is provided in the prolonged end area of said bottom part with a tap for a mounting screw whose shank passes through a slot provided in said top part and running in the direction of displacement of said top part with respect to said bottom part.

15. A hinge according to claim 14, comprising a tongue-and-groove connection provided in confronting surfaces of the prolonged end areas of said top and bottom parts, said tongue-and-groove connection running in the direction of displacement of said top part.

16. A hinge according to claim 14 or 15, wherein said top part has a bottom face, and a projection on said top part adjacent said hinge link, said projection projecting from said bottom face and having a hook appendage projecting from said projection parallel to said bottom surface in the longitudinal direction of said mounting plate, and a through-opening in said bottom part opposite said projection, said through-opening serving to accommodate said projection and being wider in the direction of displacement than said projection and having an undercut defining edge running in the direction of displacement, under which said hook appendage is held.

17. A hinge according to claim 1 wherein said supporting arm has a longitudinal slot with an open mouth adjacent said hinge link, said mounting screw having a head, a threaded shank, and a thread-less neck portion between said head and shank, said neck portion having a diameter which is at most equal to the free width of said longitudinal slot, whereas the outer diameter of said threaded shank is greater than the free width of said longitudinal slot.

* * * * *